US010589531B2

(12) United States Patent
Kawamura et al.

(10) Patent No.: US 10,589,531 B2
(45) Date of Patent: Mar. 17, 2020

(54) LIQUID EJECTION HEAD AND LIQUID EJECTION APPARATUS

(71) Applicant: CANON KABUSHIKI KAISHA, Tokyo (JP)

(72) Inventors: Shogo Kawamura, Kawasaki (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/108,113

(22) Filed: Aug. 22, 2018

(65) Prior Publication Data

US 2019/0070849 A1 Mar. 7, 2019

(30) Foreign Application Priority Data

Sep. 6, 2017 (JP) ..... 2017-171549

(51) Int. Cl.

| | |
|---|---|
| ***B41J 2/175*** | (2006.01) |
| ***B41J 2/14*** | (2006.01) |
| ***B41J 29/13*** | (2006.01) |
| ***B41J 25/34*** | (2006.01) |

(52) U.S. Cl.

CPC ..... *B41J 2/1752* (2013.01); *B41J 2/14072* (2013.01); *B41J 25/34* (2013.01); *B41J 29/13* (2013.01); *B41J 2002/14362* (2013.01); *B41J 2002/14491* (2013.01); *B41J 2202/12* (2013.01); *B41J 2202/14* (2013.01); *B41J 2202/18* (2013.01)

(58) Field of Classification Search

CPC . B41J 2/1752; B41J 29/13; B41J 25/34; B41J 2002/14362; B41J 2202/14; B41J 2202/12; B41J 2/14072; B41J 2202/18; B41J 2002/14491

See application file for complete search history.

(56) References Cited

U.S. PATENT DOCUMENTS

| | | | | |
|---|---|---|---|---|
| 6,257,703 | B1 | 7/2001 | Hirosawa et al. | |
| 6,394,580 | B1 * | 5/2002 | Scheffelin ..... | B41J 2/14201 347/42 |
| 6,536,868 | B1 | 3/2003 | Kawamura et al. | |
| 9,238,361 | B2 | 1/2016 | Muraoka et al. | |
| 9,884,485 | B2 | 2/2018 | Yoshikawa et al. | |

(Continued)

FOREIGN PATENT DOCUMENTS

| | | | |
|---|---|---|---|
| JP | 02-78588 | A | 3/1990 |

*Primary Examiner* — Geoffrey S Mruk
(74) *Attorney, Agent, or Firm* — Venable LLP

(57) ABSTRACT

A liquid ejection head can suppress the influence of static electricity and the increase of a mounting force as well as downsize and save space of the liquid ejection head. The liquid ejection head is attachable and detachable with respect to a body connector provided on a liquid ejection apparatus body. Further, the liquid ejection head includes a head connector including a terminal which can be electrically connected to the body connector and a grounding member which is held at a coverage position where the terminal is covered in a non-contacting state with the body connector. The grounding member is formed with a deformable electroconductive member, and, as the head connector is made to move to a mounting position with respect to the body connector, is pressed by the body connector and is displaced to a position apart from the coverage position. Thus, the body connector can be connected with the terminal.

13 Claims, 14 Drawing Sheets

(56) References Cited

U.S. PATENT DOCUMENTS

| | | | |
|---|---|---|---|
| 9,902,163 | B2 | 2/2018 | Yoshikawa et al. |
| 2016/0339711 | A1 | 11/2016 | Muraoka et al. |
| 2018/0361748 | A1 | 12/2018 | Inada et al. |
| 2019/0001674 | A1 | 1/2019 | Ishimatsu et al. |
| 2019/0009533 | A1 | 1/2019 | Kodoi et al. |

* cited by examiner

LIQUID EJECTION HEAD AND LIQUID EJECTION APPARATUS

BACKGROUND OF THE INVENTION

Field of the Invention

The present invention relates to a liquid ejection head attachably/detachably mounted in a liquid ejection apparatus body and a liquid ejection apparatus.

Description of the Related Art

Currently, a liquid ejection apparatus that ejects liquid is used for inkjet printing apparatuses and various kinds of liquid ejection. As one of the liquid ejection apparatuses, an apparatus including a liquid ejection head attachably/detachably mounted therein which ejects liquid in response to a control signal and the like from the apparatus body is known. As for such a liquid ejection head, a user holds the liquid ejection head in his/her hand to attach it to a body connector provided in the liquid ejection apparatus body or to remove it from the body connector. In this case, if the user's hand directly touches a terminal that makes electrical connection with the liquid ejection head, static electricity accumulated and charged in the user may possibly damage multiple electronic components and printing boards which are connected to the terminals.

In order to resolve such a problem, Japanese Patent Laid-Open No. H02-78588 (1990) discloses providing on a liquid ejection head an opening/closing member which is urged by a spring and covering a terminal part with the opening/closing member to protect a circuit board and the like from static electricity charged by a user.

However, there is a problem that the technique disclosed in Japanese Patent Laid-Open No. H02-78588 (1990) requires an area for incorporating the opening/closing member and an area for allowing a spring deformation, which results in an increase in the size of the ejection head. Further, an urging force applied to the opening/closing member will be a reaction force at the time of mounting the liquid ejection head and the urging force will continuously apply a force in a drawing direction to an electrical connection part of the print head after being mounted. This may possibly cause change or deterioration in an electrically connected state.

SUMMARY OF THE INVENTION

In consideration of the above problem, an object of the present invention is to provide a liquid ejection head which can achieve suppressing the influence of static electricity and the increase of a mounting force as well as downsizing and space saving of the liquid ejection head and a liquid ejection apparatus.

The present invention is a liquid ejection head attachable and detachable with respect to a body connector provided in a liquid ejection apparatus body, the liquid ejection head comprising: a head connector including a terminal which can be electrically connected to the body connector; and a grounding member which is held at a coverage position that covers the terminal in a non-contacting state with the body connector. The grounding member is formed with a deformable electroconductive member, and, as the head connector is made to move to a mounting position with respect to the body connector, is pressed by the body connector and is displaced to a position apart from the coverage position so that the body connector and the terminal can be connected.

According to the present invention, there are provided the liquid ejection head which can achieve suppressing the influence of static electricity and the increase of a mounting force as well as downsizing and space saving of the liquid ejection head and the liquid ejection apparatus.

Further features of the present invention will become apparent from the following description of exemplary embodiments with reference to the attached drawings.

DESCRIPTION OF THE EMBODIMENTS

With reference to the drawings, explanations will be given below of embodiments of the liquid ejection head according to the present invention. However, the embodiments explained below do not limit the scope of the present invention. For instance, as a liquid ejection method of the liquid ejection apparatus in the present embodiments, a thermal method of ejecting liquid by generating bubbles using an electrothermal transducer (heat generating element) that transduces electric energy into thermal energy as an element that generates energy to be used for ejecting liquid is employed. However, the present invention is also applicable to a liquid ejection head that employs a liquid ejecting method using an electromechanical transducer (piezoelectric element) that transduces electric energy into mechanical energy and other types of liquid ejecting methods. In addition, according to the embodiments described below, an inkjet print head mounted on an inkjet printing apparatus that performs printing on a print medium by ejecting ink is shown by way of example. However, the present invention can also be applied to a liquid ejection head which is mounted on an apparatus other than the inkjet printing apparatus and which ejects liquid other than ink.

First Embodiment

Figure 1:
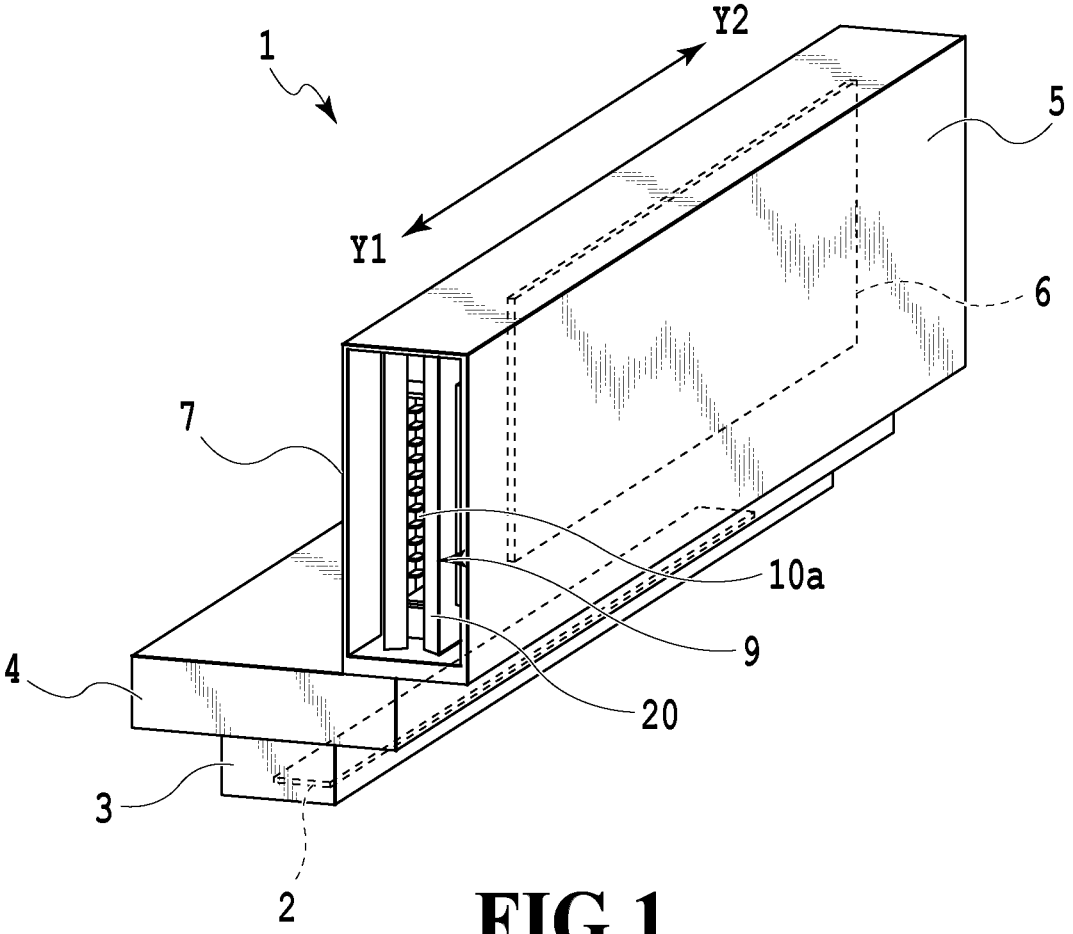
FIG. 1 is an appearance perspective view showing the entire configuration of a liquid ejection head according to a first embodiment of the present invention.
Figure 2:
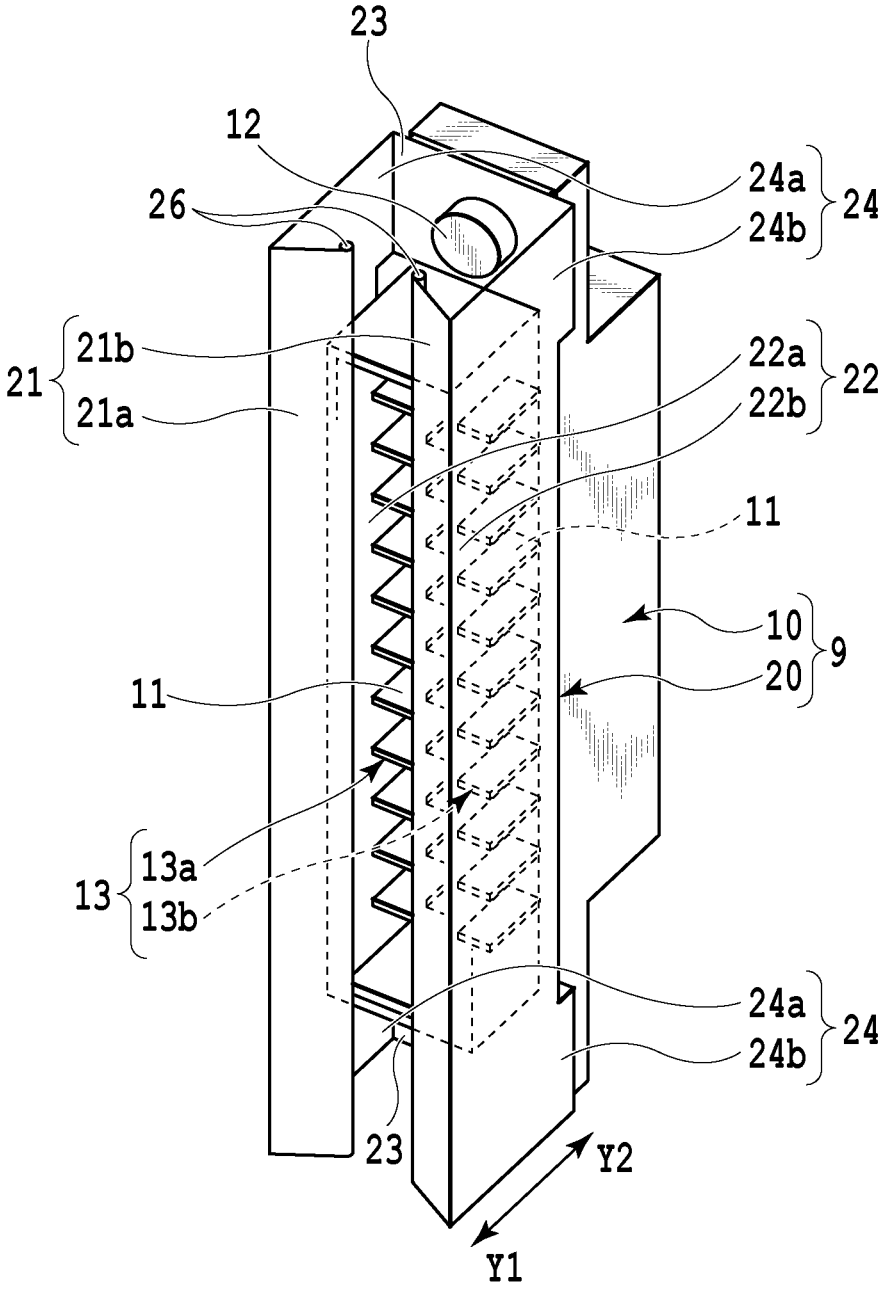
FIG. 2 is a perspective view showing a configuration of a connector unit provided in the liquid ejection head.
Figure 3A:
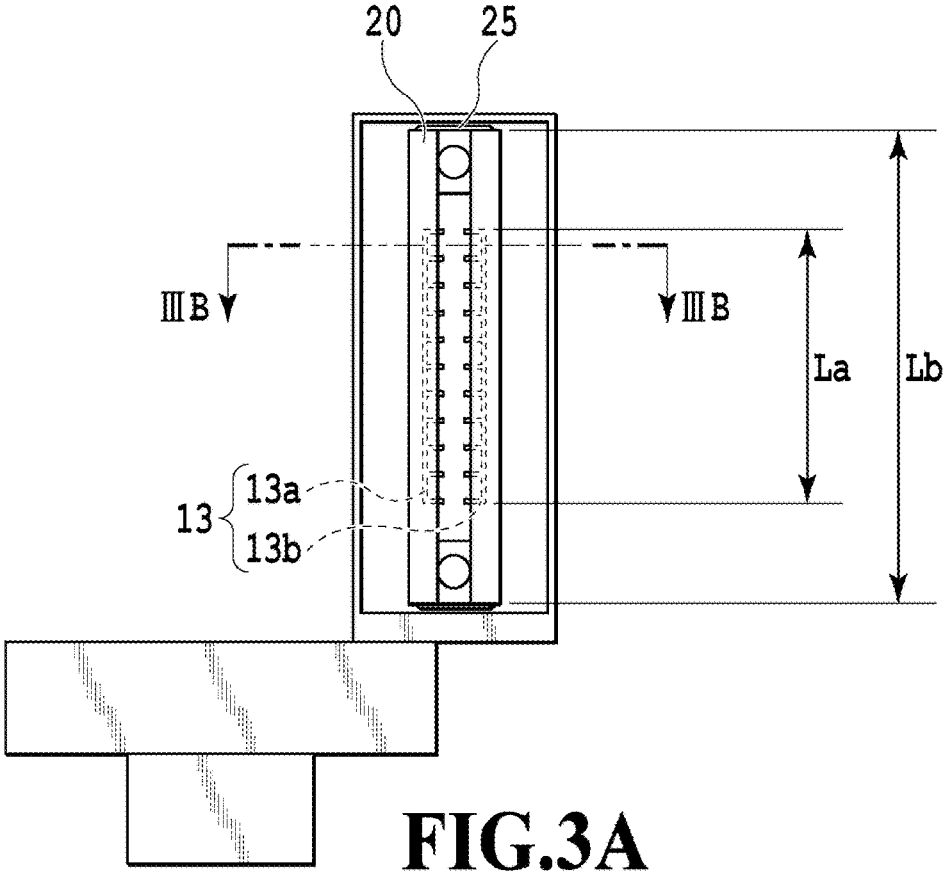
FIG. 3A is a side view of the liquid ejection head according to the first embodiment.
Figure 3B:
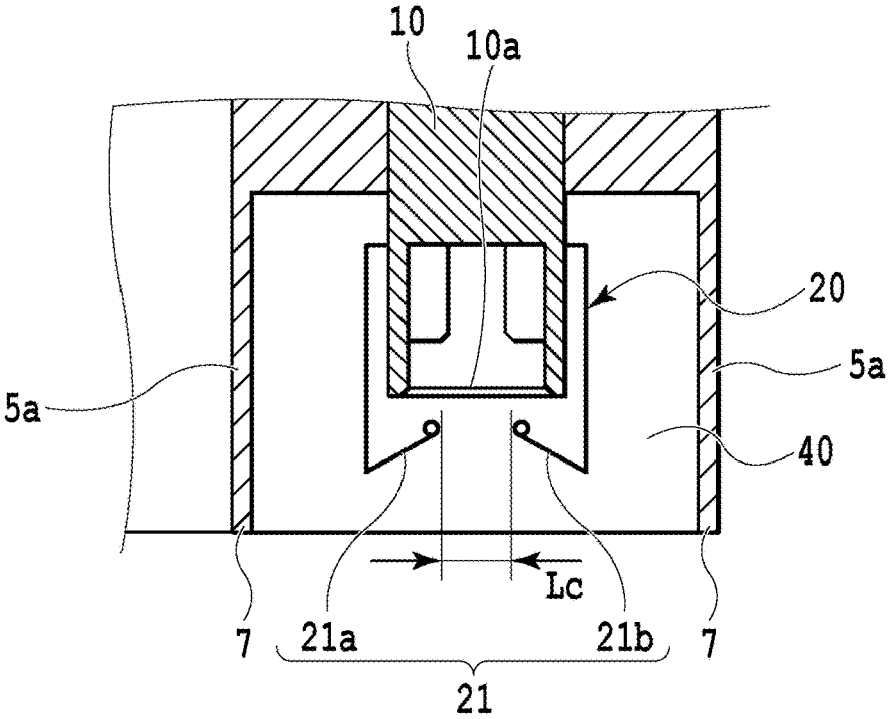
FIG. 3B is a partially enlarged view of a cross section taken along a line IIIB-IIIB of FIG. 3A.

FIG. 1 is an appearance perspective view showing the entire configuration of a liquid ejection head according to the first embodiment of the present invention. FIG. 2 is a perspective view showing a configuration of a connector unit provided in the liquid ejection head shown in FIG. 1. FIG. 3A is a side view of the liquid ejection head shown in FIG. 1, and FIG. 3B is a partially enlarged view of a cross section taken along a line IIIB-IIIB of FIG. 3A.

A liquid ejection head 1 in the present embodiment shown in FIG. 1 is an inkjet print head of a line type (hereinafter simply referred to as a print head). At the bottom of the liquid ejection head 1, a print element board 2 is arranged throughout the liquid ejection head in a width direction. At least one print element board 2 may be provided, and in a case of providing a plurality of print element boards 2, they may be arranged in a staggered manner along the longitudinal direction of the print head. In the present embodiment, the plurality of print element boards 2 are arranged in a linear manner (in-line) to provide a downsized print head suitable for high quality printing. A plurality of ejection ports arrayed on each print element board are arranged in a given pitch along the width direction (Y direction in the figure) of a print medium to be used. Ink (liquid) ejected from these ejection ports allows printing for each line on the print medium. The present invention can be suitably applied to the print head of a page-wide type (line type) shown in the figure. However, the present invention is not limited to this, and is also applicable to the print head of a serial type.

The print head 1 includes a flow path member 3 in which a flow path is formed for conveying ink to the print element board 2 and a frame 4 for supporting the flow path member 3. On the upper part of the frame 4, a box 5 is disposed as a housing. In the box 5, a circuit board 6 that controls the plurality of print element boards 2 and a connector unit 9 electrically connected to the circuit board 6 are contained. Further, in the box 5, an opening 7 is formed. From this opening 7, an insertion port 10*a* of the connector unit 9 is exposed to the outside.

In the present embodiment, the print head is configured to circulate ink, and the flow path member 3 includes a common supply flow path for supplying liquid to a pressure chamber (not shown) that includes a heat generating element and a common collection flow path for collecting liquid from the pressure chamber. In other words, ink within the pressure chamber is configured to be circulated through the outside of the pressure chamber.

As shown in FIG. 2, the connector unit 9 includes a head connector 10 and a grounding member 20 fixed to the head connector 10. On the head connector 10, two terminal rows each composed of a plurality of terminals 11 which are electrically connectable with respect to a body connector 32 (see FIG. 5A) provided in a printer body (liquid ejection apparatus body) are arranged. Further, the grounding member 20 is formed with an elastically deformable plate-like electroconductive member.

The grounding member 20 is, together with the head connector 10, fixed to the box 5 with a metallic screw 12 and is electrically connected to a ground. To be more specific, the grounding member 20 is connected to a metallic exterior plate provided on the box 5 with the screw 12, and the exterior plate is electrically connected to a ground terminal (not shown) of the circuit board 6 via a metallic screw (not shown). Further, in the state where the liquid ejection head 1 is mounted onto a printer body 30, the grounding member 20 is electrically connected to a ground terminal (not shown) of the printer body 30 (see FIG. 4) via the body connector 32.

The grounding member 20 is one sheet metal member (plate-like member) having elasticity, which includes the following components formed thereon. Specifically, the grounding member 20 includes one pair of right and left flanges 21*a*, 21*b*, one pair of right and left webs 22*a*, 22*b* coupled to the flanges 21*a*, 21*b*, two pairs of upper and lower arms 24 coupled to the webs 22*a*, 22*b*, and one pair of upper and lower bases 23 connecting the arms 24, and they are integrally formed. It should be noted that, in each figure, Y1 indicates a mounting direction of the liquid ejection head 1 with respect to the printer body, and Y2 indicates a removing direction of the liquid ejection head.

The pair of flanges 21*a*, 21*b* is held frontward (frontward in a mounting direction (Y1 direction)) of the head connector 10, and their ends are facing each other at a certain interval therebetween. The flanges 21*a*, 21*b* are bent acutely with respect to the webs 22*a*, 22*b*. The webs 22*a*, 22*b* extend laterally from both side faces of the head connector 10 at a certain interval. Further, the outer faces of the flanges 21*a*, 21*b* (front faces in the mounting direction) form inclined faces that are inclined toward the center of the head connector 10.

Inside the head connector 10, two terminal rows 13*a*, 13*b* are provided. At the front in the Y1 direction (frontward in the mounting direction), the insertion port 10*a* is formed. In addition, as shown in FIG. 3B, at a coverage position set frontward of one terminal row 13*a* in a mounting direction, one flange 21*a* is held, and at a coverage position set frontward of the other terminal row 13*b* in a mounting direction, the other flange 21*b* is held. In other words, the terminal rows 13*a*, 13*b* are covered by the pair of flanges 21*a*, 21*b* held at the respective covering positions set frontward.

Furthermore, an interval Lc between the pair of flanges 21*a* and 21*b* is set to an interval so as to prevent a user's finger from touching the terminals 11 of the head connector 10 without touching the grounding member 20. In the present embodiment, the interval is set to be 7 mm or less. Furthermore, end portions 26 of the flanges 21*a*, 21*b* are each formed in a cylindrical shape, and are configured to prevent damages in a case where the user unintentionally inserted his/her finger or the like into a clearance between both end portions. It should be noted that, in a case where the right and left are not particularly required to be distinguished from each other, the flanges 21*a*, 21*b*, the arms 24*a*, 24*b*, and the terminal rows 13*a*, 13*b*, for example, may be collectively referred to as flange(s) 21, terminal row(s) 13, and arm(s) 24.

The head connector 10 and the grounding member 20 are covered with the walls of the box 5 for housing them, and the insertion port 10*a* of the connector unit 9 is exposed to the outside at the opening 7 formed on the walls. Into the insertion port 10*a*, the body connector 32 provided in the printer body 30 intrudes (see FIG. 5B) at the time of mounting the liquid ejection head 1 into the liquid ejection apparatus body (printer body) 30. In this case, as the outer faces of the body connector 32 press the flanges 21 of the grounding member 20 outwardly (in a lateral direction), the flanges 21*a*, 21*b* as well as the webs 22 and the arms 24*a*, 24*b* are elastically deformed toward right and left side walls 5*a* of the box 5. For this reason, between the side walls 5*a* of the box 5 and the grounding member 20, a space 40 (see FIG. 3B) having a width (an interval in a lateral direction) is formed so as not to prevent the elastic deformation of the flanges 21*a*, 21*b*.

Moreover, as for the grounding member 20, as shown in FIG. 3A, a length Lb of the flange 21 of the head connector 10 is set to be longer than a length La of the terminal row 13 thereof, and edges 25 on the top and bottom of the flange 21 are arranged so as to be proximate to the top and bottom walls of the box 5. In the present embodiment, a clearance formed between each of the edges 25 at the top and bottom of the flanges 21 and at the top and bottom of the walls of the box 5 is set to be about 1 to 3 mm. Accordingly, even if the user's hand touches the grounding member 20, the edges 25 will not be touched, thereby reducing the possibility of occurrence of damages.

Figure 4:
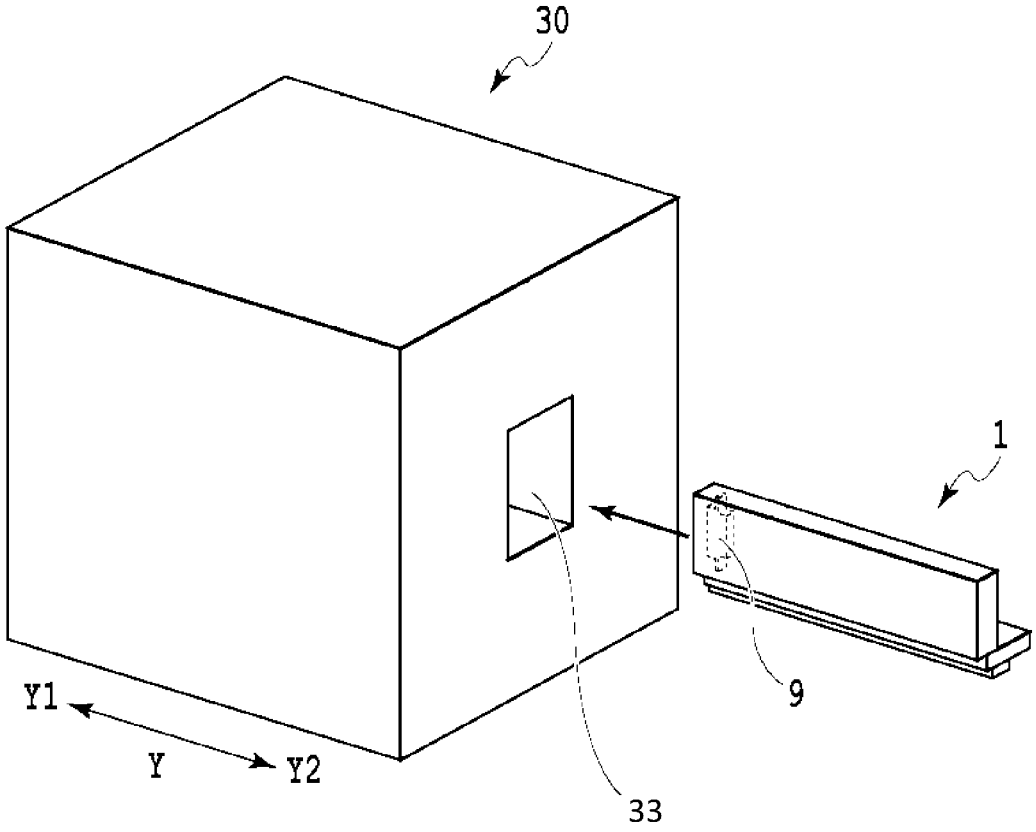
FIG. 4 is a perspective view showing a method of mounting the liquid ejection head into a printer body.

FIG. 4 is a perspective view showing a method of mounting the liquid ejection head 1 of the first embodiment into the printer body 30. As shown in FIG. 4, the print head 1 is mounted, with the connector unit 9 facing frontward, into a head mounting window 33 provided in the printer body 30. As to the liquid ejection head 1 mounted into the printer body 30, the connector unit 9 is electrically connected to the body connector 32 (see FIG. 5A) provided in the printer body 30.

Since this mounting task is made by a user by holding the print head 1 in his/her hand, in a case where the user's hand or finger touches the connector unit, static electricity accumulated in the user may be discharged to the connector unit, and this may possibly affect the circuit board. However, in the present embodiment, even if the user's hand or finger moves toward the connector unit 9 side, it firstly touches the grounding member 20 that covers frontward of the connector unit 9 before touching the connector unit 9, thereby preventing the circuit board 6 and other electronic components within the print head from being affected.

Figure 5A:
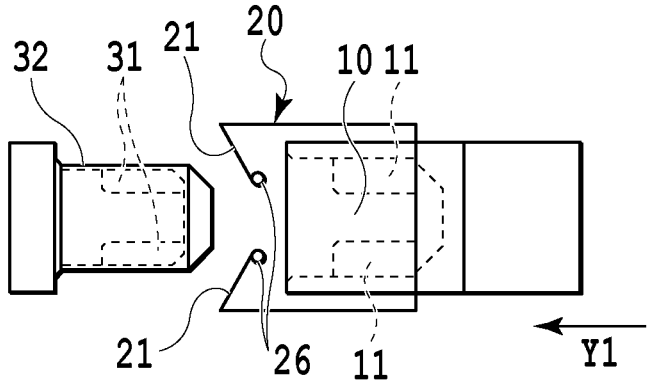
FIGS. 5A to 5D are diagrams showing, in steps, the states of a head connector and a body connector in the case of mounting the liquid ejection head into the printer body.
Figure 5B:
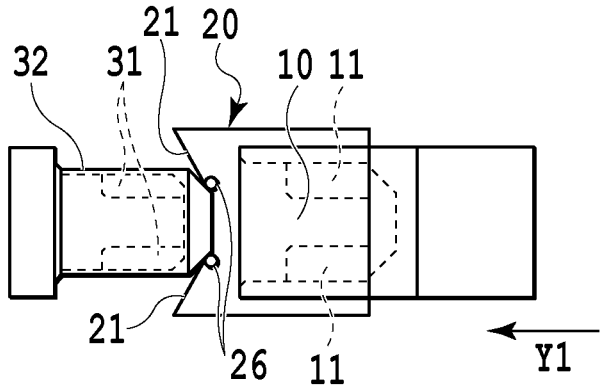
Figure 5C:
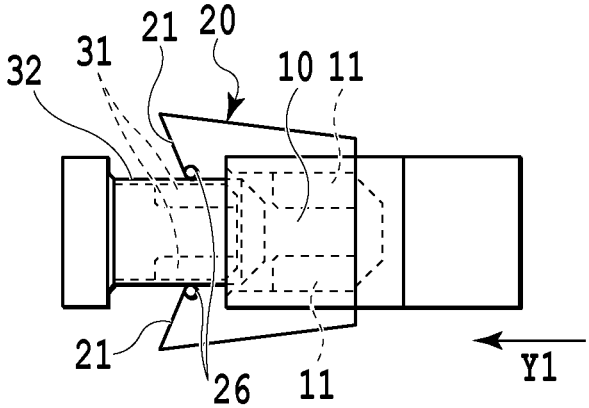
Figure 5D:
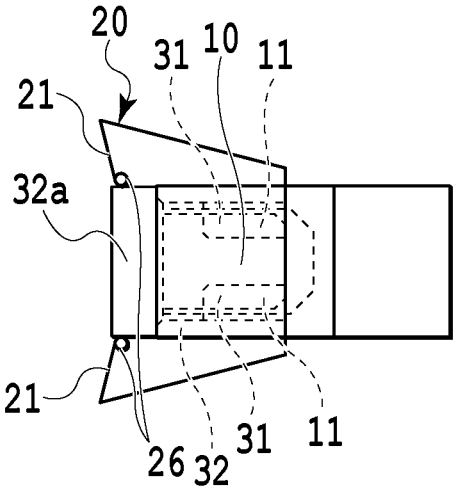

FIGS. 5A to 5D are diagrams showing, in steps, the states of the head connector 10 and the body connector 32 in the case of mounting the print head 1 into the printer body 30. Among FIGS. 5A to 5D, FIG. 5A shows a state in which the connector unit 9 is not in contact with the body connector 32 (non-contacting state), and FIG. 5B shows a state in which the body connector 32 initially contacts the grounding member 20. Further, FIG. 5C shows a state in which the body connector moves forward while contacting the grounding member, and FIG. 5D shows the state of connection completion.

As shown in FIG. 5A, the connector unit 9 of the print head 1 that has been inserted into the head mounting window 33 of the printer body 30 moves toward the body connector 32. Then, as shown in FIG. 5B, the flange 21 of the grounding member 20 contacts the tip end of the body connector 32 (a right end in the figure). Further, as the connector unit 9 moves in the mounting direction (Y1 direction), the flanges 21 are pressed outwardly by the body connector 32, and along with this movement, the webs 22 and the arms 24 are also displaced outwardly. Thereafter, as the cylindrical end portions 26 of the flanges 21 move in the Y1 direction while contacting the side faces of the body connector 32, the end portions 26 contact a root part 32*a* of the body connector as shown in FIG. 5D. As a result, the terminal 11 of the head connector 10 reaches a mounting position where the terminal comes in contact with a terminal 31 of the body connector 32, and thus the electrical connection between the head connector 10 and the body connector 32 is completed.

As described above, according to the liquid ejection head (print head) 1 of the present embodiment, the grounding member 20 is configured to make slight elastic deformation (displacement) at the time of attaching to or detaching from the printer body. Accordingly, the space saving of the print head can be achieved compared to the conventional configuration in which the opening/closing member and a spring that urges the member are separately provided. In addition, an elastic force applied to the body connector 32 from the grounding member 20 in the state in which the print head 1 is mounted on the printer body 30 functions to urge the print head 1 in the mounting direction (Y1 direction). Accordingly, there is no risk that the urging force added by the grounding member 20 will lose the state of electrical connection between the terminal 11 and the terminal 31. Further, since the flanges 21 are only slightly displaced (deformed) upon the mounting, the liquid ejection head 1 can be mounted with a light mounting force.

In addition, the end portions of the flanges 21 are formed in a cylindrical shape, it is possible to suppress damages not only to a human body but also to the body connector 32 contacting the flanges.

Second Embodiment

Figure 6:
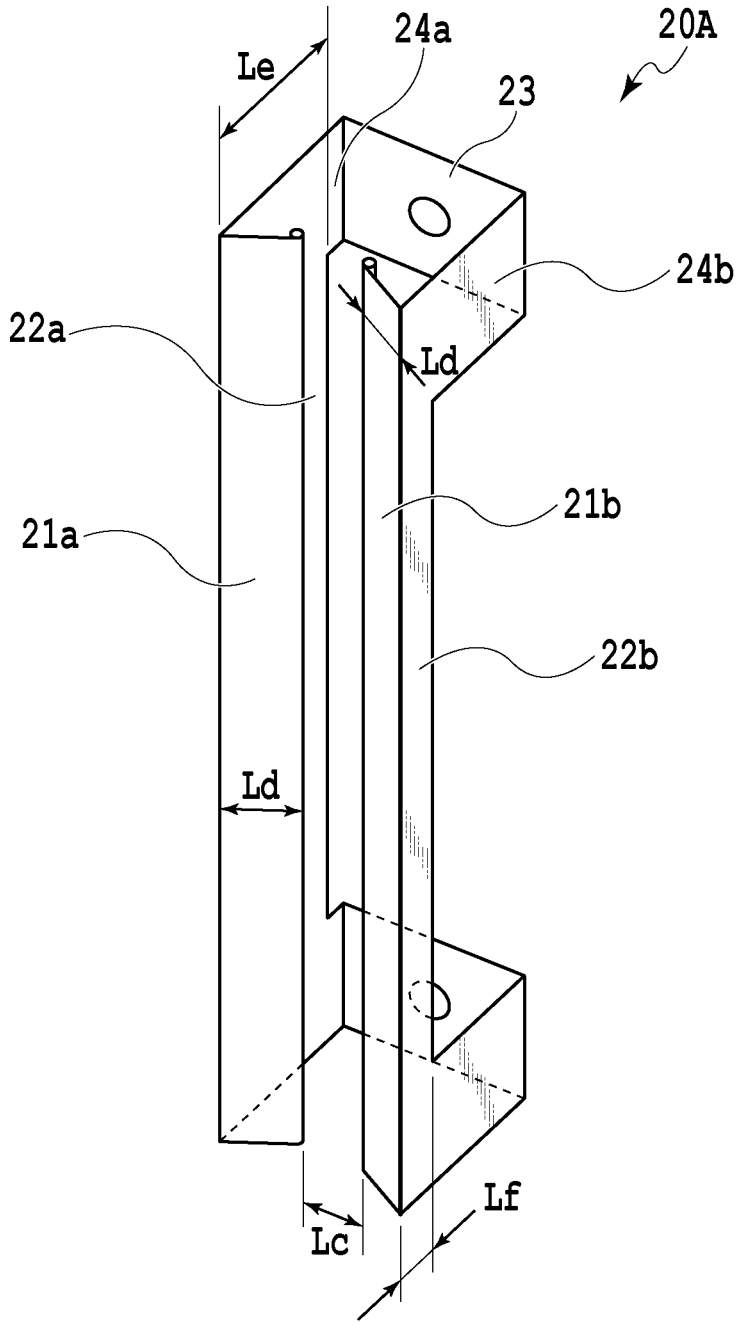
FIG. 6 is a perspective view of a grounding member used for the liquid ejection head according to a second embodiment.
Figure 7A:
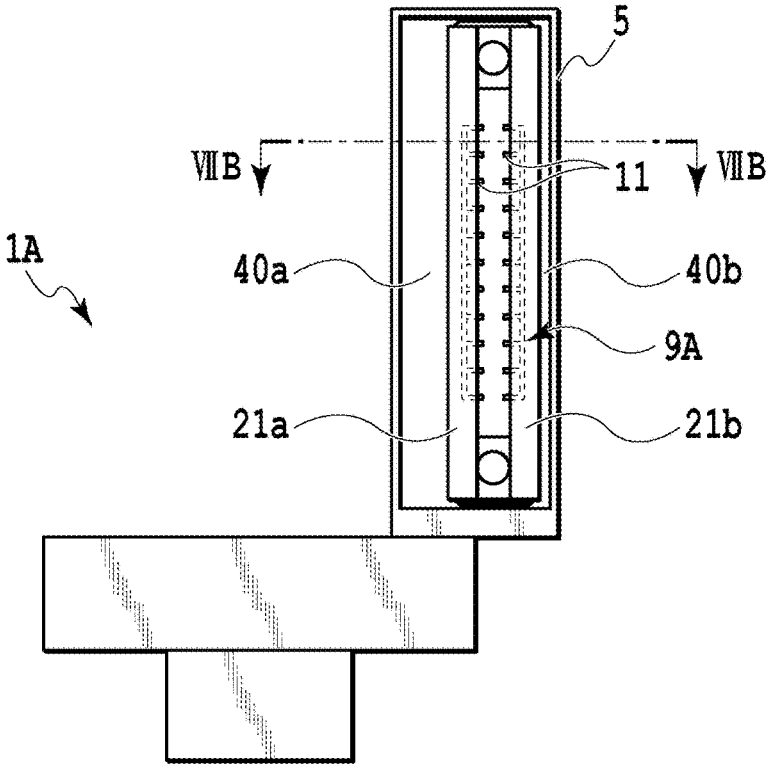
FIG. 7A is a front view of a print head 1A according to the second embodiment.
Figure 7B:
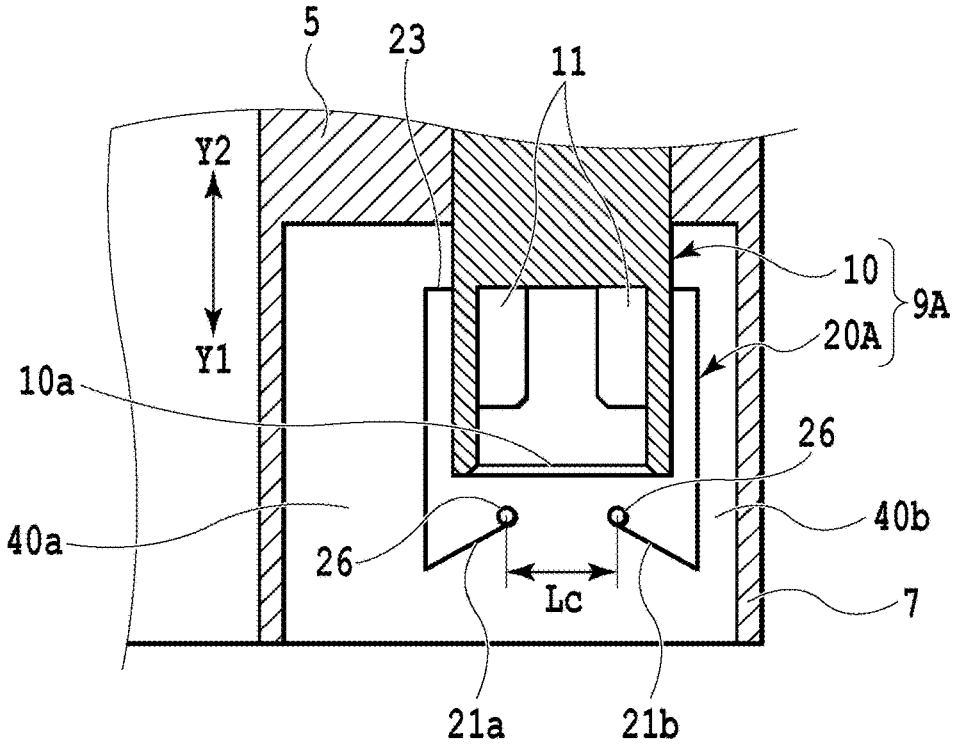
FIG. 7B is a cross-sectional enlarged view taken along a line VIIB-VIIB of FIG. 7A.
Figure 8:
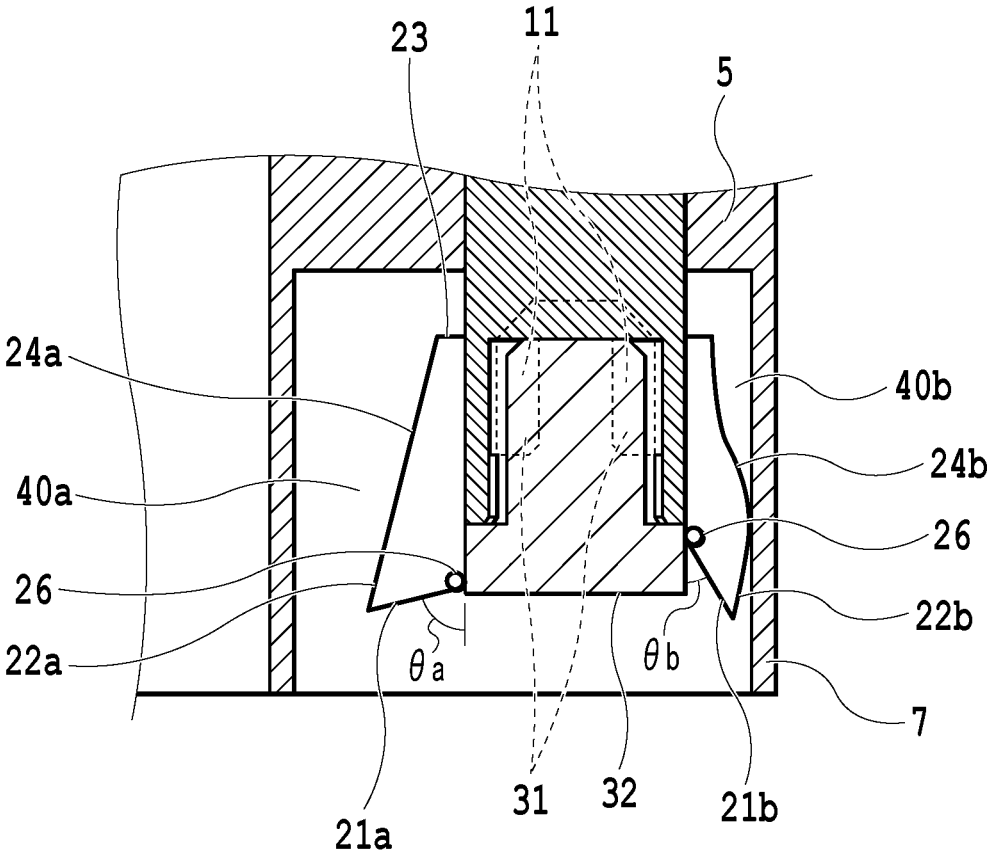
FIG. 8 is a cross-sectional enlarged view showing a connection state between a connector unit and the body connector shown in FIG. 7A.

Next, the second embodiment of the present invention will be described. FIG. 6 is a perspective view of a grounding member 20A used for a liquid ejection head (print head) 1A according to the second embodiment. Further, FIGS. 7A and 7B are views showing the print head 1A according to the second embodiment. Specifically, FIG. 7A is a front view and FIG. 7B is a cross-sectional enlarged view taken along a line VIIB-VIIB of FIG. 7A. FIG. 8 is a cross-sectional enlarged view showing the state in which a connector unit 9 of the second embodiment is connected to the body connector 32.

The print head (liquid ejection head) 1A of the second embodiment includes the grounding member 20A as shown in FIG. 6. As for the grounding member 20A, a length Le of a web 22*a* is formed to be longer than a length Ld of the inclined face of a flange 21*a*, and an arm 24*a* is formed to be short. Meanwhile, a length Lf of a web 22*b* is equal to or less than a length Ld of the inclined face of a flange 21*b*, and accordingly, an arm 24*b* is formed to be long. This is, as in FIGS. 7A and 7B, an example of adapting to the case where a space 40*b* on the side of the flange 21*b* is narrow. In other words, in a case where one space 40*b* is narrow and the other space 40*a* is wide, the length of the web 22*b* is set to be equal to or less than that of the flange 21*b* to form the long arm 24*b*. It should be noted that other configurations are identical to those of the first embodiment.

In the liquid ejection head 1A including the grounding member 20A having the above configuration, in the case where the flange 21*b* is pressed outwardly due to the intrusion of the body connector 32, deformation of the grounding member 20A occurs mainly on the arms 24*a*, 24*b*.

As shown in FIG. 7B, between the side wall 5*a* of the box 5 and the flange 21*a*, a sufficient space 40*a* exists as in the first embodiment. Accordingly, a length Le of the web 22*a* is set to be longer than a length Ld of the flange 21*a*, and as a result of the deformation of the arm 24*a*, the web 22*a* and the flange 21*a* simply move outwardly.

Meanwhile, in a case where a space between the side wall 5*a* of the box 5 and the flange 21*b* is as narrow as the space 40*b*, a length Lf of the web 22*b* is formed to be equal to or less than an inclined length Ld of the flange 21*b* so that the arm 24*b* of the grounding member 20 is deformed as shown in FIG. 8. More specifically, as the flange 21*b* is pressed outwardly (right side in the figure) by the body connector 32, the arm 24*b* contacts the side wall 5*a* of the box 5 and then deforms in an opposite direction, thereby causing the flange 21*b* to be inclined inwardly. Consequently, compared to an angle θa between the flange 21*a* on the left side that simply extends outwardly and the body connector 32, an angle θb between the flange 21*b* on the right side and the body connector 32 is smaller. As a result, it is possible to install the grounding member 20 in the narrow space 40*b* as well.

As such, according to the second embodiment, the connector having the grounding member can be housed even in the case where one side of the space for the flange is narrow, thereby further downsizing the print head.

Third Embodiment

Figure 9:
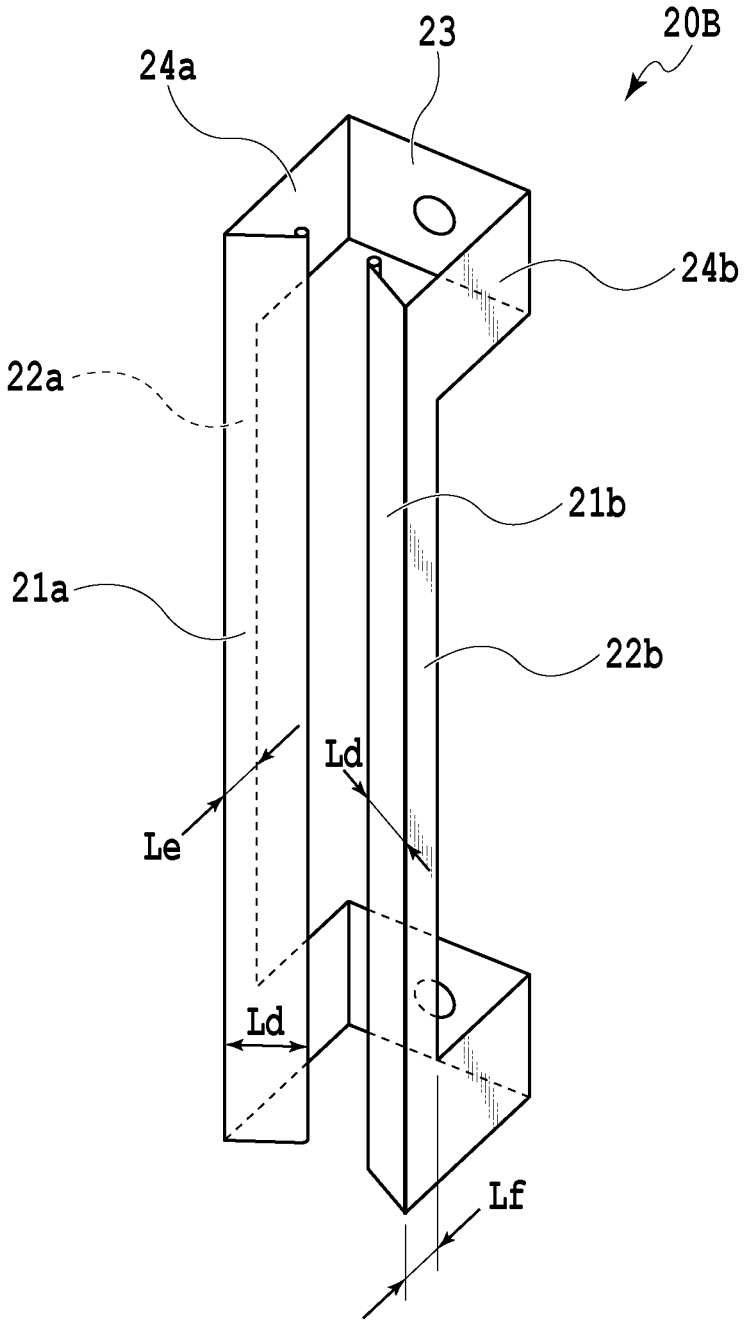
FIG. 9 is a perspective view showing a grounding member in a print head according to a third embodiment.
Figure 10A:
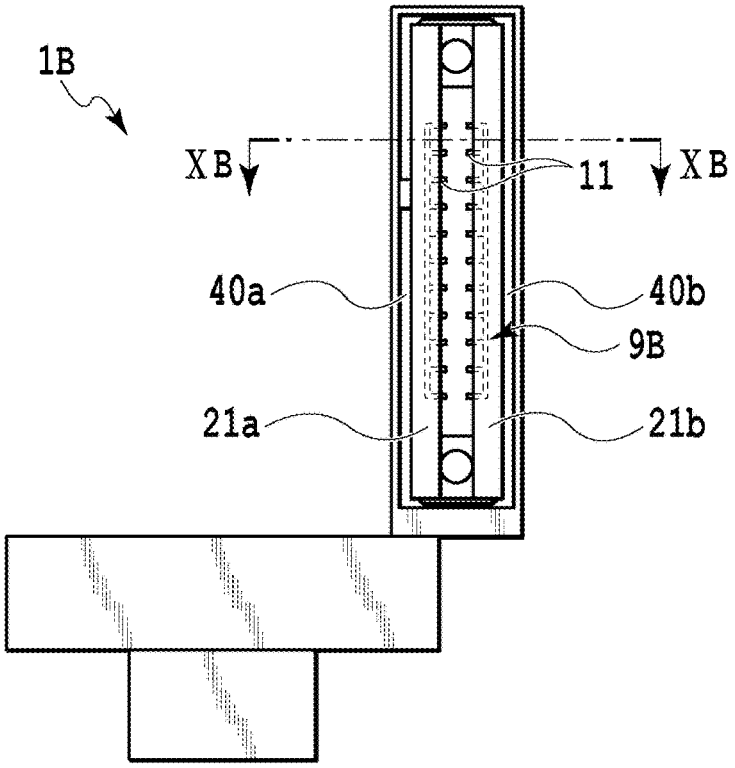
FIG. 10A is a front view of a print head 1B according to the third embodiment.
Figure 10B:
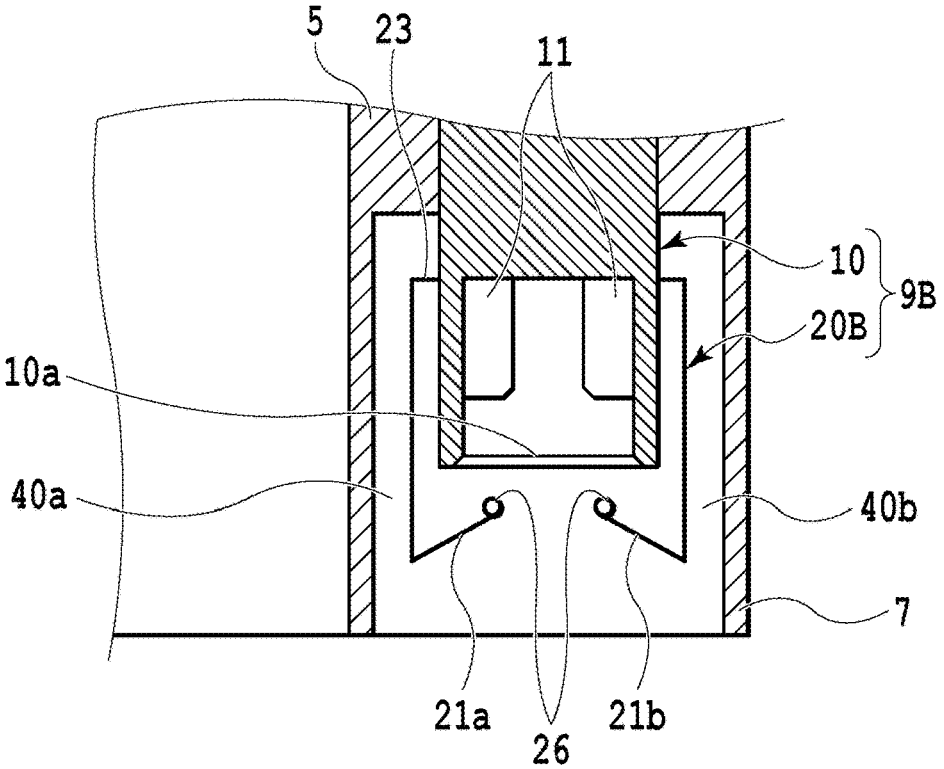
FIG. 10B is a cross-sectional enlarged view taken along a line XB-XB of FIG. 10A.
Figure 11:
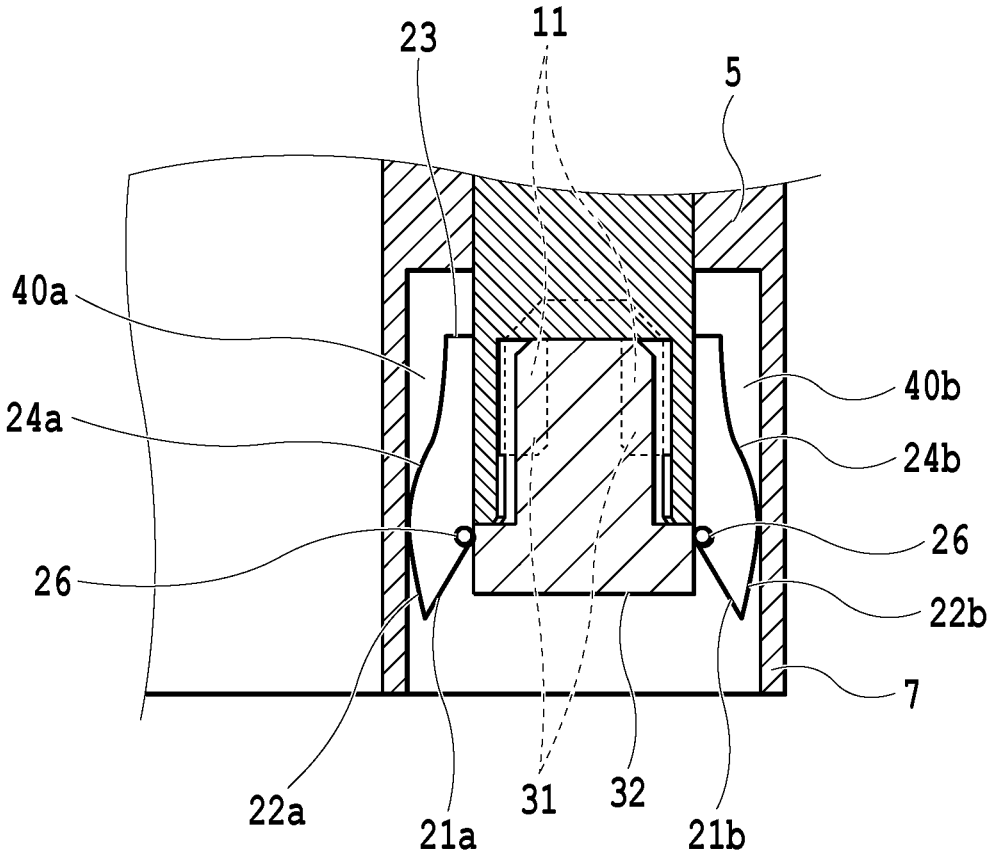
FIG. 11 is a cross-sectional enlarged view showing the state of connection between a connector unit and the body connector shown in FIG. 10A.

Next, the third embodiment of the present invention will be described. FIG. 9 is a perspective view of a grounding member 20B used for a liquid ejection head (print head) 1B in the third embodiment. FIGS. 10A and 10B are views showing the print head 1B of the third embodiment. Specifically, FIG. 10A is a front view and FIG. 10B is a cross-sectional enlarged view taken along a line XB-XB of FIG. 10A. FIG. 11 is a cross-sectional enlarged view showing the state in which a connector unit 9B is connected to the body connector 32 in the third embodiment.

The print head (liquid ejection head) 1B of the third embodiment has the grounding member 20B as shown in FIG. 9. As for the grounding member 20B, as in the second embodiment, a length Lf of the web 22*b* is formed to be equal to or less than a length Ld of the flange 21*b*. However, in the present embodiment, a length Le of the web 22*a* is also formed to be equal to or less than a length Ld of the flange 21*a*. This aspect differs from the above-described second embodiment. In addition, since the webs 22*a*, 22*b* are formed relatively shorter as described above, the arms 24*a*, 24*b* are both formed to be long in the present embodiment.

According to the liquid ejection head 1B having the grounding member 20 which is configured to be as described above, as shown in FIGS. 10A and 10B, it is applicable even in the case where spaces 40*a*, 40*b* formed on the lateral sides of both the flanges 21*a*, 21*b* are narrow. More specifically, as shown in FIG. 11, in the case where both the flange 21*a* and flange 21*b* are pressed outwardly due to the intrusion of the body connector 32, the arms 24*a*, 24*b* contact the side walls 5*a* of the box 5 and then deform in opposite directions, thereby causing both the flanges 21*a*, 21*b* to be inclined inwardly. As a result, even in the case where the spaces 40*a*, 40*b* on both sides of the grounding member 20B are narrow, it is possible to house the head connector 10 having the grounding member 20B, thereby further downsizing the print head compared to those in the first and second embodiments.

Fourth Embodiment

Figure 12:
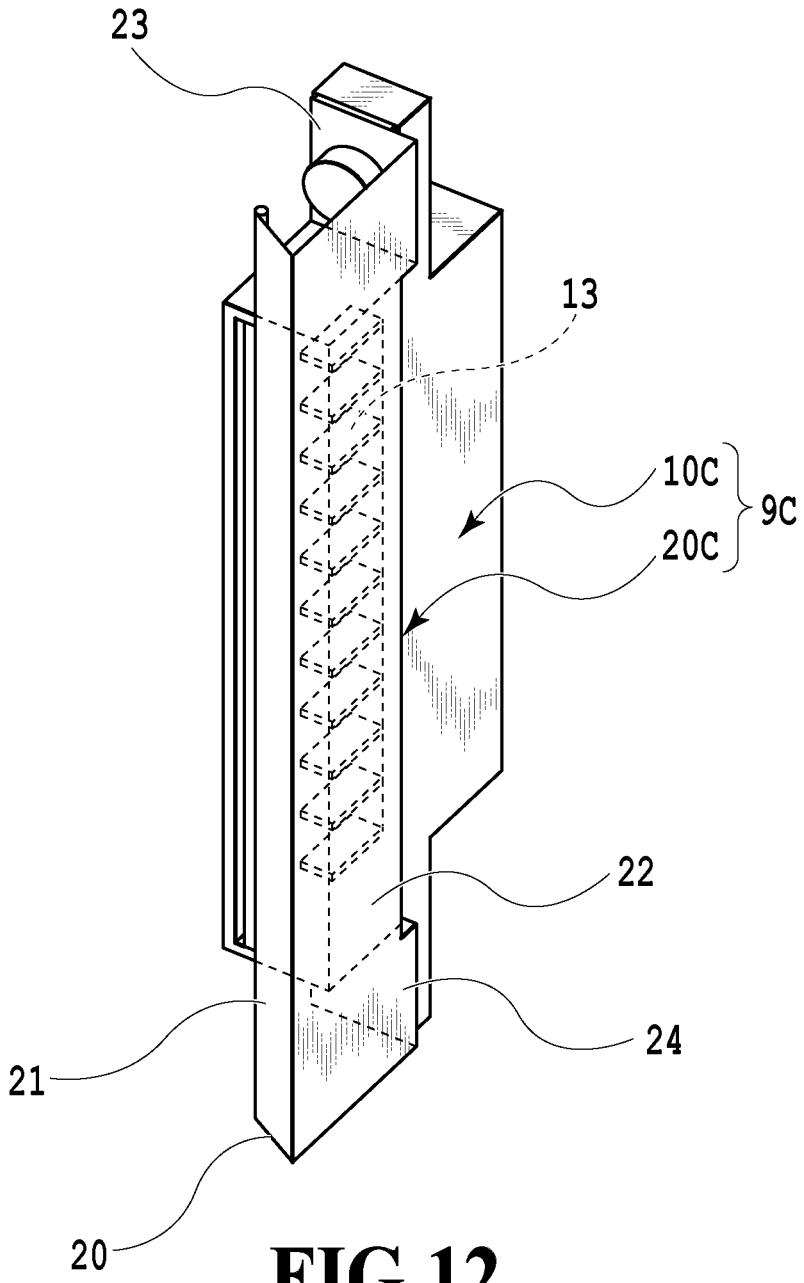
FIG. 12 is a perspective view showing a connector unit according to a fourth embodiment.

Next, the fourth embodiment of the present invention will be described. FIG. 12 is a perspective view showing a connector unit 9C of a liquid ejection head used in the fourth embodiment. The connector unit 9C in the present embodiment is composed of a head connector 10C and a grounding member 20C. In the head connector 10C, one terminal row 13 is provided. Accordingly, in the present embodiment, along with one terminal row 13, one grounding member 20C composed of a flange 21, a web 22, an arm 24, and a base 23 is provided. The grounding member 20C includes a configuration similar to the right side part of the grounding member 20 shown in the first embodiment.

As in the present embodiment, in the small-sized liquid ejection head including the connector unit 9C having one terminal row, which is similar to the grounding member 20 described in the first embodiment, the connector unit 9C and the body connector 32 can be electrically connected adequately with a light mounting force.

Fifth Embodiment

Figure 13:
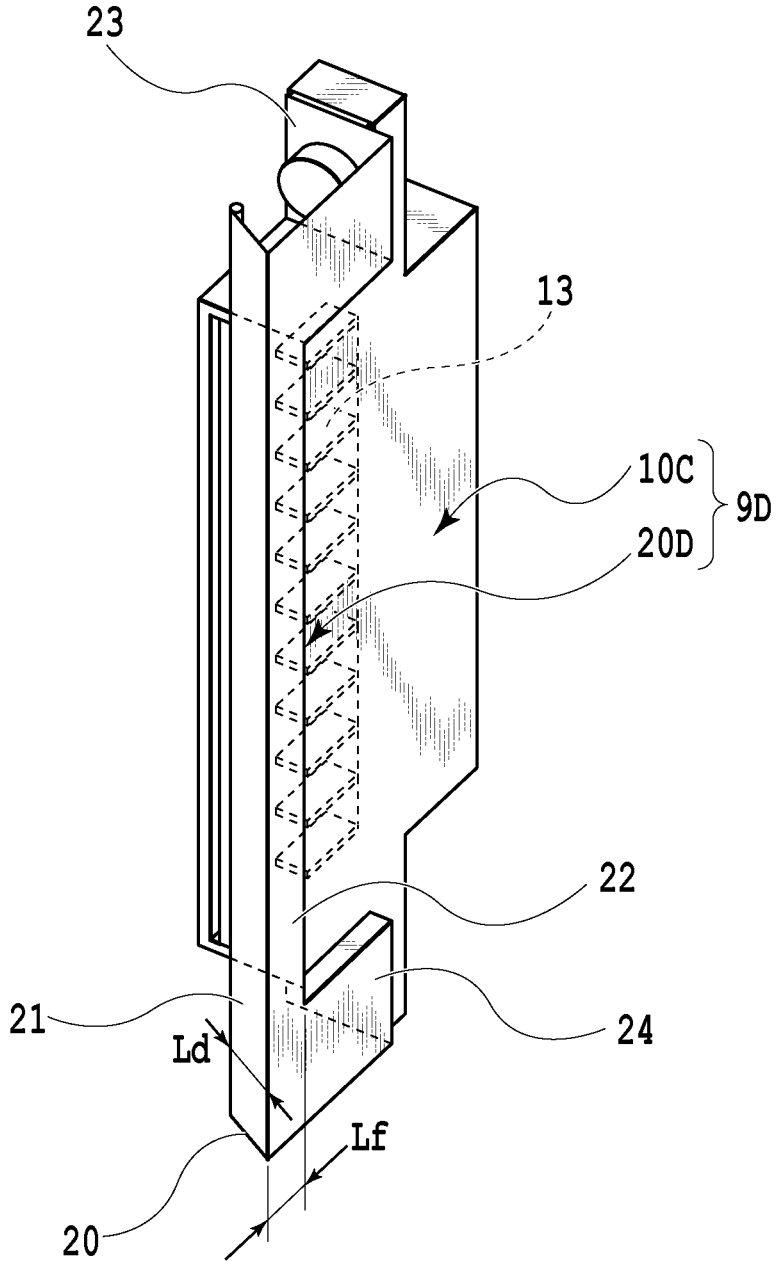
FIG. 13 is a perspective view showing a connector unit according to a fifth embodiment.

Next, the fifth embodiment of the present invention will be described. FIG. 13 is a perspective view showing a connector unit 9D of the liquid ejection head used in the fifth embodiment. In the above-described fourth embodiment, the example of including one grounding member 20C having a configuration identical to the first embodiment has been described. However, the connector unit 9D in the fifth embodiment includes one grounding member 20D having a configuration identical to the second embodiment. Specifically, in the grounding member 20D, a length Lf of the web 22 is set to be shorter than a length Ld of the flange 21 so as to accordingly form the arm 24 longer. As a result, the arm 24 is configured to be easily deformed.

The present embodiment is effective in a case where the head connector 10 has one terminal row 13 and spaces between the head connector 10 and the side walls 5*a* of the box 5 are narrow.

Sixth Embodiment

Next, the sixth embodiment of the present invention will be described. FIGS. 14A to 14D are views showing shapes of end portions of a grounding member used for a liquid ejection head (print head) in the sixth embodiment.

Figure 14A:
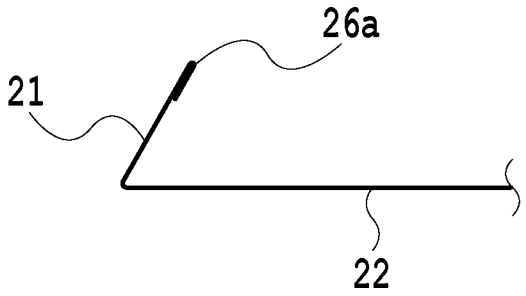
FIGS. 14A to 14D are views showing shapes of end portions of a grounding member according to a sixth embodiment.

FIG. 14A shows an example of making hemming bending on the tip end of the flange 21 to form an arcuate end portion 26*a*. This end portion 26*a* can also be expected to produce an effect similar to those in the above embodiments due to its curved shape.

Figure 14B:
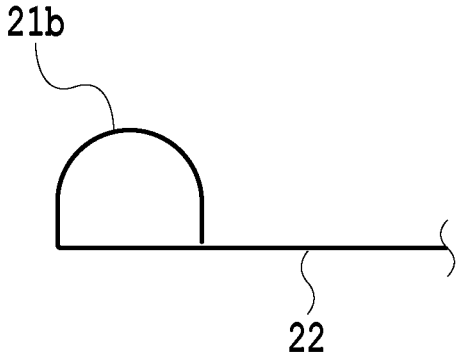
Figure 14C:
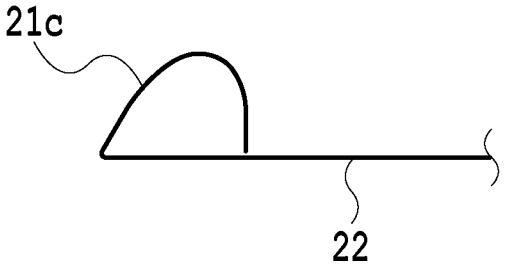
Figure 14D:
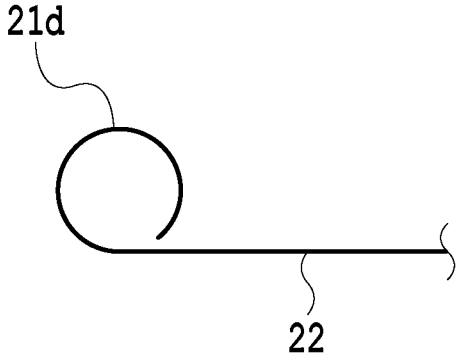

FIGS. 14B to 14C show examples of curving entire portions connected to the webs 22 such that these curved portions each form a flange of a grounding member. Specifically, FIG. 14B shows a flange 21*b* that is curved in a semicircular shape, FIG. 14C shows a flange 21*c* that is curved in a non-circular shape, and FIG. 14D shows a flange formed in a circular shape. All the flanges described above have both functions that serve as the inclined face and as the arcuate end portion 26, which are described in the first embodiment. In other words, along the outer face of the flange 21*a* of a semicircular shape, the body connector intrudes into the head connector, and along with this movement, the flange 21 moves laterally. Further, the curved portion functions to protect a user's hand or finger from damages, and simultaneously, the shape of the end portion of the flange allows preventing the body connector contacting the flange from being damaged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-171549, filed Sep. 6, 2017, which is hereby incorporated by reference herein in its entirety.

What is claimed is:

1. A liquid ejection head attachable and detachable with respect to a body connector provided in a liquid ejection apparatus body, the liquid ejection head comprising:

a head connector including a terminal which can be electrically connected to the body connector; and a grounding member which is held at a coverage position where the terminal is covered in a non-contacting state with the body connector, wherein the grounding member is formed with a deformable electroconductive member, and, as the head connector is made to move to a mounting position with respect to the body connector, is pressed by the body connector and is displaced to a position apart from the coverage position so that the body connector and the terminal can be connected, wherein the grounding member is formed of a sheet metal member including:

a flange provided at the coverage position where the terminal is covered so as to include a predetermined space, a web extending from the flange to a lateral side of the head connector, a base fixed to the head connector, and an arm connecting the web and the base, and wherein the head connector is made to move to a mounting position with respect to the body connector so that the flange is pressed by the body connector to move from the coverage position toward the lateral side of the head connector.

2. The liquid ejection head according to claim 1, wherein the grounding member is a plate-like member having elasticity.

3. The liquid ejection head according to claim 1, wherein the flange is bent to an acute angle relative to the web.

4. The liquid ejection head according to claim 1, wherein a length of the flange is longer than a length of the web.

5. The liquid ejection head according to claim 1, wherein the flange has an arcuate end portion.

6. The liquid ejection head according to claim 1, wherein the flange has a curved shape.

7. The liquid ejection head according to claim 1, wherein the head connector and the grounding member are housed in a housing body, and are exposed through an opening formed at an end of the housing body, and end portions of the flange are both proximate to the opening.

8. The liquid ejection head according to claim 1, wherein the flange comprises a pair of members provided from two facing sides of the head connector.

9. The liquid ejection head according to claim 8, wherein the pair of members are arranged to have a clearance of 7 mm or less.

10. The liquid ejection head according to claim 1, wherein the liquid ejection head is of a page-wide type including a plurality of print element boards each having elements for generating energy to be used for ejecting liquid.

11. The liquid ejection head according to claim 10, wherein the plurality of print element boards are aligned along a longitudinal direction of the liquid ejection head.

12. The liquid ejection head according to claim 10, further comprising pressure chambers including one of the elements provided therein, wherein liquid in the pressure chambers is circulated externally of the pressure chambers.

13. A liquid ejection apparatus including a liquid ejection apparatus body and a liquid ejection head attachable and detachable with respect to a body connector provided in the liquid ejection apparatus body, wherein the liquid ejection head comprises:

a head connector including a terminal which can be electrically connected to the body connector; and a grounding member which is held at a coverage position that covers the terminal in a non-contacting state with the body connector, wherein the grounding member is formed with a deformable electroconductive member, and, as the head connector is made to move to a mounting position with respect to the body connector, is pressed by the body connector and is displaced to a position apart from the coverage position so that the body connector and the terminal can be connected, wherein the grounding member is formed of a sheet metal member including:

a flange provided at the coverage position where the terminal is covered so as to including a predetermined space, a web extending from the flange to a lateral side of the head connector, a base fixed to the head connector, and an arm connecting the web and the base, and wherein the head connector is made to move to a mounting position with respect to the body connector so that the flange is pressed by the body connector to move from the coverage position toward the lateral side of the head connector.

* * * * *